US009353649B2

(12) United States Patent
Rioux

(10) Patent No.: US 9,353,649 B2
(45) Date of Patent: May 31, 2016

(54) WEAR LINER SPRING SEAL

(71) Applicant: UNITED TECHNOLOGIES CORPORATION, Hartford, CT (US)

(72) Inventor: Philip Robert Rioux, North Berwick, ME (US)

(73) Assignee: United Technologies Corporation, Hartford, CT (US)

( * ) Notice: Subject to any disclaimer, the term of this patent is extended or adjusted under 35 U.S.C. 154(b) by 752 days.

(21) Appl. No.: 13/736,437

(22) Filed: Jan. 8, 2013

(65) Prior Publication Data

US 2014/0241874 A1 Aug. 28, 2014

(51) Int. Cl.
*F01D 25/24* (2006.01)

(52) U.S. Cl.
CPC ..... *F01D 25/246* (2013.01); *Y10T 29/49321* (2015.01)

(58) Field of Classification Search
CPC ..... F01D 9/042; F01D 25/246
USPC ..... 415/209.2, 209.3
See application file for complete search history.

(56) References Cited

U.S. PATENT DOCUMENTS

| | | | | |
|---|---|---|---|---|
| 4,897,021 | A | 1/1990 | Chaplin et al. | |
| 5,192,185 | A | 3/1993 | Leonard | |
| 5,333,995 | A | 8/1994 | Jacobs et al. | |
| 5,639,211 | A | 6/1997 | Bintz | |
| 6,062,813 | A | 5/2000 | Halliwell et al. | |
| 6,139,264 | A | 10/2000 | Schilling | |
| 7,238,003 | B2 | 7/2007 | Synnott et al. | |
| 7,445,426 | B1 * | 11/2008 | Matheny et al. | 415/135 |
| 8,105,016 | B2 | 1/2012 | Butz et al. | |
| 2006/0045746 | A1 | 3/2006 | Synnott | |
| 2009/0044770 | A1 | 2/2009 | Scott et al. | |
| 2010/0068050 | A1 | 3/2010 | Hansen et al. | |
| 2011/0135479 | A1 | 6/2011 | Ueda et al. | |
| 2012/0076659 | A1 | 3/2012 | Robertson | |
| 2012/0128481 | A1 * | 5/2012 | Baumas et al. | 415/209.2 |
| 2013/0089417 | A1 * | 4/2013 | Wiebe et al. | 415/209.2 |
| 2013/0209249 | A1 * | 8/2013 | Langlois et al. | 415/209.3 |

FOREIGN PATENT DOCUMENTS

| | | | |
|---|---|---|---|
| DE | 102007059220 | A1 * | 6/2009 |
| WO | 2011/035798 | A1 | 3/2011 |

OTHER PUBLICATIONS

DE 10 2007 059 220 A1 Machine Translation. Accessed EPO website May 1, 2015. 11 pages.*

International Search Report & Written Opinion for International Application No. PCT/US2014/010160 mailed on Oct. 16, 2014.

International Preliminary Report on Patentability for International Application No. PCT/US2014/010160 mailed on Jul. 23, 2015.

* cited by examiner

*Primary Examiner* — Richard Edgar
(74) *Attorney, Agent, or Firm* — Carlson, Gaskey & Olds, P.C.

(57) ABSTRACT

A wear liner for a stator vane includes a shaped member, comprising a U-shaped portion that receives a foot of a stator vane. A first end of the wear liner is biased into contact with the stator vane. A spring seal extends from the U-shaped portion and into bias contact with an inner surface of the support structure to further prevent leakage between the stator foot and case support structure.

15 Claims, 3 Drawing Sheets

WEAR LINER SPRING SEAL

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Stator airfoils are supported on features defined within an inner case. The features typically include grooves or slots that receive flanges known as feet or hooks. The fit of the feet within the grooves of the inner case are typically a clearance fit that accommodates relative thermal growth during operation. The relative movement can cause wear as well as provide an undesired leak path. Liners are typically provided within the grooves to reduce wear. Leakage is accommodated by utilizing tight tolerances between components. However, the tight tolerances make assembly and manufacture difficult while also increasing costs.

SUMMARY

A wear liner for a stator vane according to an exemplary embodiment of this disclosure, among other possible things includes a shaped member including a U-shaped portion for receiving a foot of a stator vane, a first end biased into contact with the stator vane, and a spring seal extending from the U-shaped portion and biased into contact with a support structure supporting the stator vane.

In a further embodiment of the foregoing wear liner, the first end includes a curve intersecting transverse surfaces of the foot.

In a further embodiment of any of the foregoing wear liners, includes a second end extending transverse overlapping an outer surface of the foot.

In a further embodiment of any of the foregoing wear liners, the second end defines a foot for holding the wear liner onto the vane foot.

In a further embodiment of any of the foregoing wear liners, the spring seal is attached to the U-shaped portion.

In a further embodiment of any of the foregoing wear liners, the wear liner includes a single sheet of material.

A stator mount assembly according to an exemplary embodiment of this disclosure, among other possible things includes a slot formed on a case structure for receiving a vane foot, and a wear liner includes a U-shaped portion for receiving a foot of a stator vane, a first end biased into contact with the stator vane and a spring seal extending from the U-shaped portion and biased into contact with a support structure supporting the stator vane.

In a further embodiment of the foregoing stator mount assembly, the slot includes a groove on an radially outer surface for receiving the spring seal.

In a further embodiment of any of the foregoing stator mount assemblies, the first end includes a curve intersecting transverse surfaces of the foot.

In a further embodiment of any of the foregoing stator mount assemblies, the wear liner includes a second end extending transverse overlapping an outer surface of the foot.

In a further embodiment of any of the foregoing stator mount assemblies, the spring seal is attached to the U-shaped portion.

In a further embodiment of any of the foregoing stator mount assemblies, the wear liner includes a single sheet of material.

A method of mounting a vane within a gas turbine engine according to an exemplary embodiment of this disclosure, among other possible things includes inserting a vane foot within a U-shaped portion of a wear liner, and inserting the vane foot and wear liner into a slot formed within an support structure such that spring seal of the wear liner engages a surface of the slot.

In a further embodiment of the foregoing method, includes sealing a first curved end of the wear liner against abutting transverse surfaces of the vane foot.

In a further embodiment of any of the foregoing methods, includes inserting the spring seal into a groove formed in an outer surface of the slot.

In a further embodiment of any of the foregoing methods, includes the step of biasing the spring seal against an inner surface of the slot responsive to leakage pressure past the first end.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
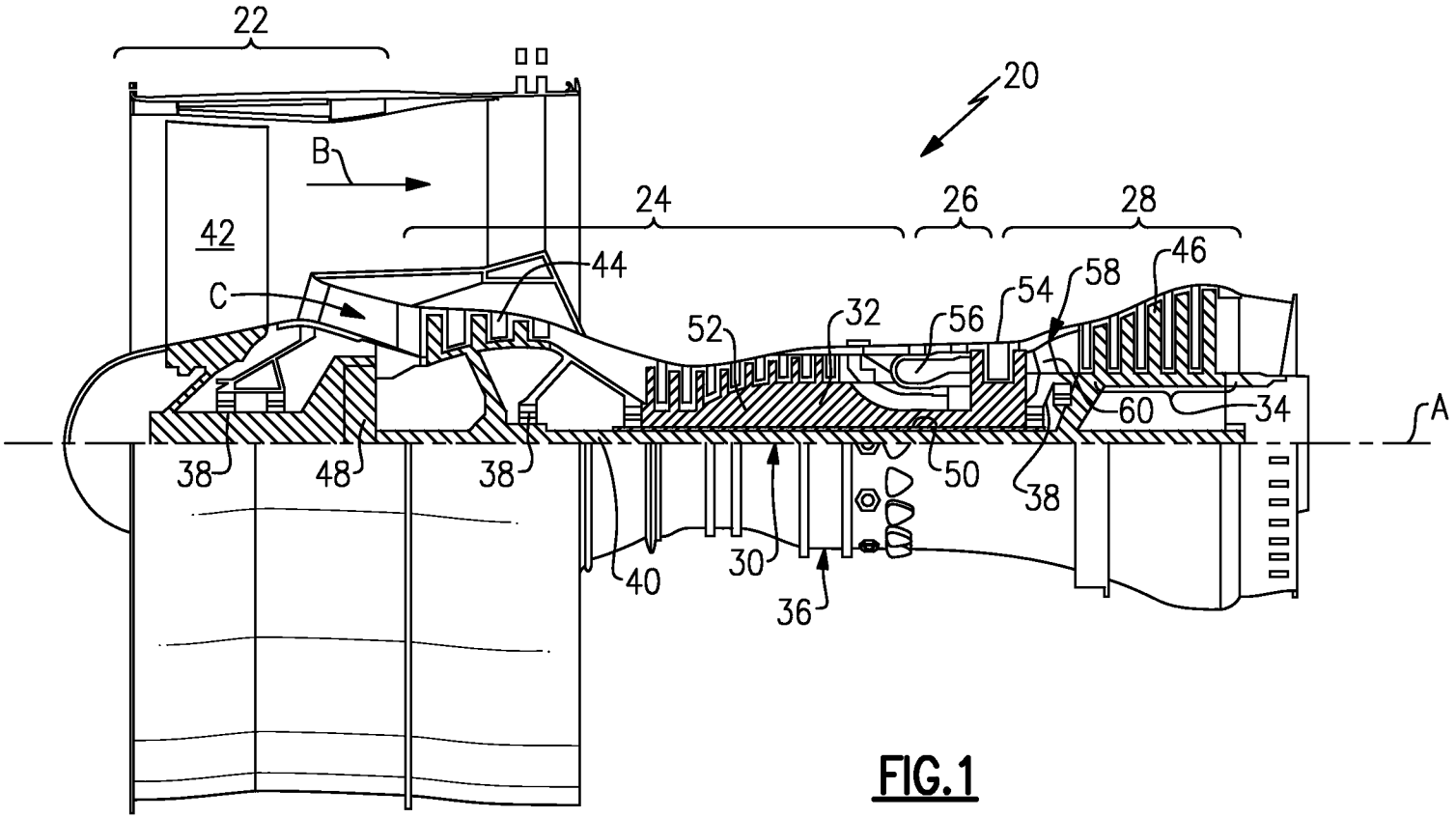
FIG. 1 is a schematic view of an example gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram} \circ \text{R})/(518.7 \circ \text{R})]^{0.5}$. The "Low corrected fan tip speed", as disclosed herein according to one non-limiting embodiment, is less than about 1150 ft/second.

The example gas turbine engine includes the fan 42 that comprises in one non-limiting embodiment less than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Figure 2:
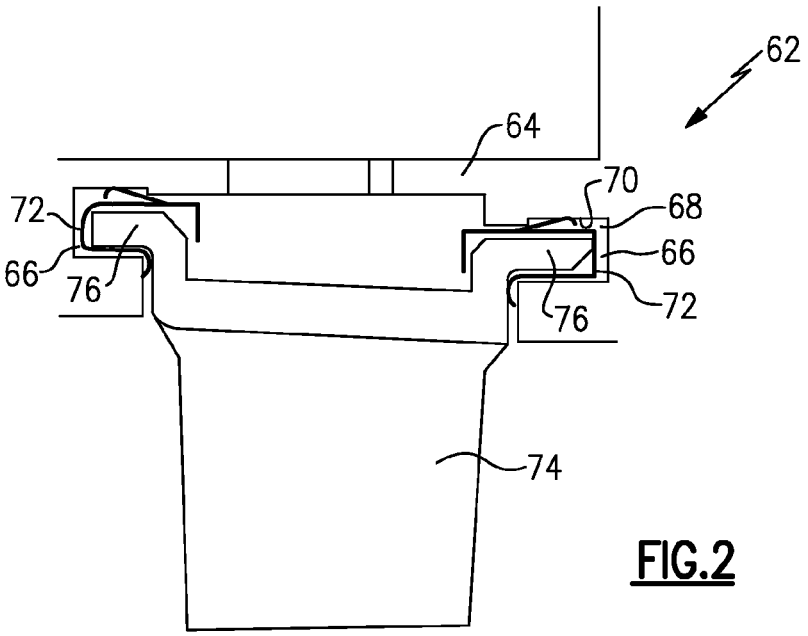
FIG. 2 is a section view of a stator vane mounted within a case structure.

Referring to FIG. 2, a stator section 62 of the example gas turbine engine 20 includes a stator vane 74 having stator feet 76 that are received within slot 66 defined within a case structure 64. In this example, the case structure 64 provides the support for the vane 74 within corresponding slots 66. The vane feet 76 are received within the slots 66 of the case 64. The slots 66 include an outer surface 70 with a groove 68.

A wear liner 72 is disposed between the vane feet 76 and the inner surfaces of the slot 66. The wear liner 72 provides wear protection for the inner case surfaces along with wear protection for the vane feet 76. In this example, the wear liner 72 includes features that also provide for sealing against leakage past the vane feet 76.

Figure 3:
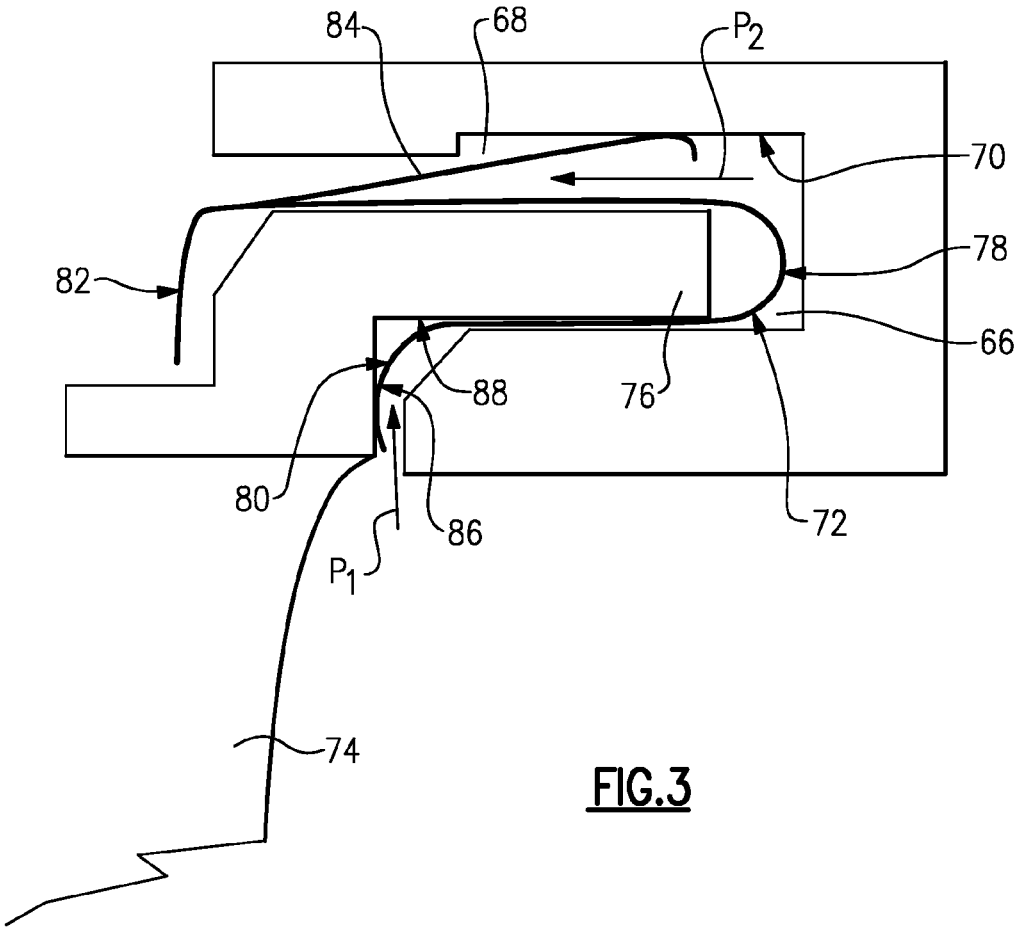
FIG. 3 is an enlarged view of one stator vane foot.
Figure 4:
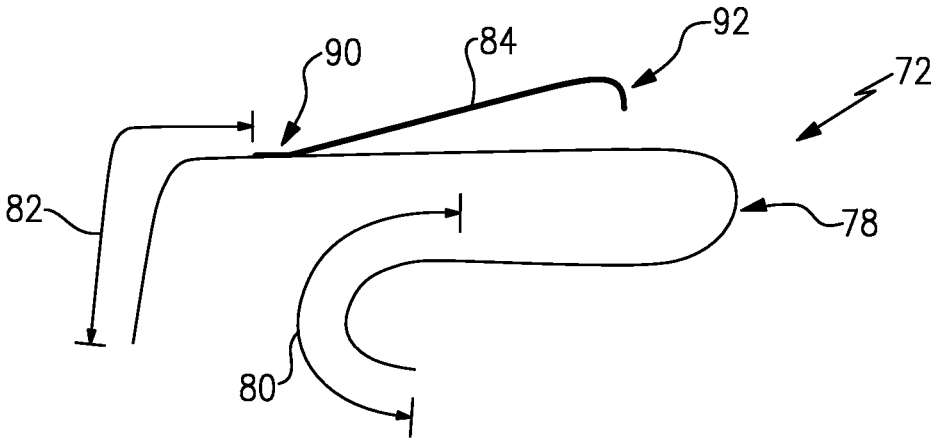
FIG. 4 is a cross-sectional view of an example wear liner.

Referring to FIGS. 3 and 4, with continued reference to FIG. 2, the example wear liner 72 includes a U-shaped portion 78 that receives the vane foot 76. The U-shaped portion 78 is disposed about an end of the vane foot 76. A first end portion 80 is disposed at a radially inward most portion of the slot 66. The first end portion 80 includes a curved surface that intersects corresponding transverse surfaces 86, 88 of the vane foot 76.

The contact with the first surface 86 and the second surface 88 of the example vane foot 76 provides a sealing contact between the wear liner 72 and the vane foot 76. A first pressure P1 exerts a pressure on the first end portion 80 that biases the first end portion 80 against the first surfaces 86, 88. Increases in the first pressure P1 further bias the first end portion against the surfaces 86, 88 to prevent leakage of air, and/or combustion gases between the liner 72 and the vane foot 76.

The wear liner 72 also includes a spring seal 84 that extends from the U-shaped portion 78 to abut an outer surface 70 of the slot 66. The spring seal 84 abuts the outer surface 70 and is biased against the outer surface 70 by a leakage pressure force P2. A curved end portion 92 of the spring seal 84 includes a curved portion 92 that eases insertion of the assembled wear liner 72 into the slot 66. Further, the curved end portion 92 further defines a sealing contact point with the surface 70.

The slot 66 includes a groove 68 that provides extra space for the spring seal 84. In this example of the spring seal 84 abuts the outer surface 70 that is defined within the groove 68 of the slot 66.

A second end 82 of the wear liner 72 forms a hook that wraps around an inner surface of the foot 76 to maintain and hold the wear liner 72 onto the vane foot 76 during assembly.

The example wear liner 72 is comprised of a metal planar sheet that extends a length and width of the foot 76. The metal sheet wear liner 72 provides wear inhibiting properties while also including the spring seal 84 that biases against the outer surface 70 to provide a further sealing function.

In this example, the spring seal 84 is welded to the U-shaped portion 78 by a weld joint 90. The weld joint 90 enables the simple construction of the wear liner 72 from sheet metal material. The material properties of the metal sheet utilized to form the disclosed wear liner 72 are compatible with the temperatures and pressures encountered during operation. Further, the surface finish of the wear liner 72 is such that the desired contact seal is formed with the inner surface 70 of the slot 66 and the surface of the vane foot 76. Moreover it is within the contemplation of this disclosure that the wear liner 72 may include a coating to further inhibit wear and providing the desired sealing properties.

Figure 5:
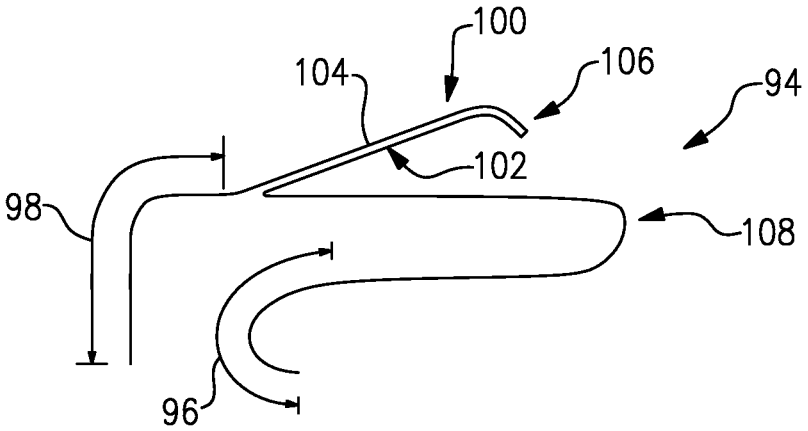
FIG. 5 is a cross-sectional view of another example wear liner.

Referring to FIG. 5, with continued reference to FIG. 3, another example wear liner 94 is disclosed and includes an integral single sheet construction. The single sheet construction includes the first end 96, second end 98 and U-shaped portion 108. The example wear liner 94 includes the spring seal portion 100 that is fabricated from a bent over portion of sheet metal material such that a first side 102 is bent transversely in respect to the U-shaped portion 108, about a hook portion 106 and down to form a second outer portion 104 that flows smoothly back to the second end portion 98. Utilizing a single piece of material with the example bent over spring seal construction eliminates the requirements for welding joints as is provided in the other disclosed embodiment.

Referring back to FIG. 3, the example wear liner 72 is assembled to the vane 74 by first assembling the wear liner 72 about the corresponding vane foot 76. The U-shaped portion 78 will be biased inward to provide a snug fit onto the vane foot 76. The second end 82 comprises a hook that further maintains the wear liner 72 on the vane foot 76 prior to assembly into the slot 66. With the wear liner 72 assembled to the vane foot 76, the vane foot 76 and the wear liner 72 are inserted into the slot 66. The spring seal 84 extends upward and into biased contact with the outer surface 70 defined within the groove 68 of the slot 66.

During operation, pressure P1 biases the first end 80 into contact against the first surface 86 and the second surface 88 of the vane foot 76. Leakage flow past the first end 80 or about an outer surface on opposite surfaces contacting the vane foot 76 provides bias pressure P2 that further pushes the spring seal 84 up against the outer surface 70 to provide the desired sealing contact. The spring seal 84 is compliant and capable of accommodating relative movement and thermal growth between the case structure 64 and the vane foot 76.

Accordingly, the disclosed wear liner 72 provides a spring seal that snaps into a slot defined within the inner case structure to provide a further leakage seal and accommodate relative thermal expansion between the vane 74 and the case structure 64.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A wear liner for a stator vane comprising:

a shaped member comprising a U-shaped portion for receiving a foot of a stator vane;

a first end biased into contact with the stator vane;

a second end extending past an outer surface of the foot of the stator vane;

a spring seal extending from the second end axially toward the U-shaped portion and biased into contact with a case structure supporting the stator vane.

2. The wear liner as recited in claim 1, wherein the first end comprises a curve intersecting transverse surfaces of the foot.

3. The wear liner as recited in claim 1, including a second end including a portion extending radially inward and overlapping an outer surface of the foot.

4. The wear liner as recited in claim 3, wherein the second end defines a foot for holding the wear liner onto the vane foot.

5. The wear liner as recited in claim 1, wherein the spring seal is attached near the second end and includes a curved end portion that extends axial toward the U-shaped portion.

6. The wear liner as recited in claim 1, wherein the wear liner comprises a single sheet of material.

7. A stator mount assembly comprising:

a slot formed on a case structure for receiving a vane foot, the slot including a groove; and a wear liner including a U-shaped portion for receiving a foot of a stator vane, a first end biased into contact with a radially inner surface of the stator vane, a second end extending over a radially outer surface of the stator vane and a spring seal extending axial away from the second end toward the U-shaped portion and biased into contact with the case structure supporting the stator vane.

8. The stator mount assembly as recited in claim 7, wherein the slot includes a groove on an radially outer surface for receiving the spring seal.

9. The stator mount assembly as recited in claim 7, wherein the first end comprises a curve intersecting transverse surfaces of the foot.

10. The stator mount assembly as recited in claim 7, wherein the second end extends transverse to the radially outer surface of the stator vane and overlaps an outer surface of the foot.

11. The stator mount assembly as recited in claim 7, wherein the spring seal is attached to near the second end and extends toward the U-shaped portion.

12. The stator mount assembly as recited in claim 7, wherein the wear liner comprises a single sheet of material.

13. A method of mounting a vane within a gas turbine engine comprising:

inserting a vane foot within a U-shaped portion of a wear liner; and inserting the vane foot and wear liner into a slot formed within a case structure such that a spring seal extending axially toward the U-shaped portion and is biased against an inner surface of the slot responsive to leakage pressure for forming a sealing contact.

14. The method as recited in claim 13, including sealing a first curved end of the wear liner against abutting transverse surfaces of the vane foot.

15. The method as recited in claim 13, including inserting the spring seal into a groove formed in an outer surface of the slot.

* * * * *